US011790849B2

(12) United States Patent
Pyun et al.

(10) Patent No.: US 11,790,849 B2
(45) Date of Patent: Oct. 17, 2023

(54) DISPLAY DEVICE AND POWER SETTING METHOD THEREOF

(71) Applicant: SAMSUNG DISPLAY CO., LTD., Yongin-si (KR)

(72) Inventors: Ki Hyun Pyun, Yongin-si (KR); Hee Sook Park, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/646,547

(22) Filed: Dec. 30, 2021

(65) Prior Publication Data

US 2022/0215803 A1 Jul. 7, 2022

(30) Foreign Application Priority Data

Jan. 4, 2021 (KR) ..... 10-2021-0000556

(51) Int. Cl.
*G09G 3/3258* (2016.01)
*G09G 3/00* (2006.01)

(52) U.S. Cl.
CPC ..... *G09G 3/3258* (2013.01); *G09G 3/006* (2013.01); *G09G 2310/027* (2013.01); *G09G 2310/08* (2013.01); *G09G 2330/12* (2013.01)

(58) Field of Classification Search
CPC ..... G09G 2310/027; G09G 2310/08; G09G 2320/0247; G09G 2330/021; G09G 2330/12; G09G 2360/16; G09G 3/006; G09G 3/20; G09G 3/3258; Y02D 10/00
See application file for complete search history.

(56) References Cited

U.S. PATENT DOCUMENTS

| | | | | |
|---|---|---|---|---|
| 9,691,323 | B2 | 6/2017 | Lee et al. | |
| 10,475,393 | B2 | 11/2019 | Lee et al. | |
| 2011/0273109 | A1 | 11/2011 | Park | |
| 2014/0240305 | A1* | 8/2014 | Chae | G09G 3/3225 345/212 |
| 2016/0203746 | A1* | 7/2016 | Kim | G09G 3/3688 345/211 |

(Continued)

FOREIGN PATENT DOCUMENTS

| | | |
|---|---|---|
| KR | 10-0590271 | 6/2006 |
| KR | 10-1142637 | 5/2012 |

(Continued)

*Primary Examiner* — Kenneth Bukowski
(74) *Attorney, Agent, or Firm* — F. Chau & Associates, LLC

(57) ABSTRACT

A display device includes: a display panel including pixels; a timing controller configured to generate image data based on input image data; a data driver configured to generate a data signal corresponding to the image data and supplying the data signal to the pixels; a power supply configured to supply a first power supply voltage to the display panel; and a power controller configured to calculate a load value and a peak grayscale of the entire display panel based on the input image data, receive feedback voltages of the first power supply voltage from relatively lower quality areas in which IR drop of the first power supply voltage occurs relatively more frequently, and generate a power control signal for changing the level of the first power supply voltage based on the load value, the peak grayscale, and the feedback voltages.

20 Claims, 11 Drawing Sheets

(56) References Cited

U.S. PATENT DOCUMENTS

| | | | | |
|---|---|---|---|---|
| 2016/0293101 | A1* | 10/2016 | Jeong | G09G 3/3258 |
| 2017/0170726 | A1* | 6/2017 | Lee | G09G 3/2092 |
| 2018/0190218 | A1* | 7/2018 | Jang | G09G 3/006 |
| 2018/0196931 | A1 | 7/2018 | Cho et al. | |
| 2018/0212513 | A1* | 7/2018 | Park | H02M 3/10 |
| 2018/0364514 | A1* | 12/2018 | Liu | G09G 3/3674 |
| 2021/0264843 | A1* | 8/2021 | Pyun | G09G 3/2092 |

FOREIGN PATENT DOCUMENTS

| | | |
|---|---|---|
| KR | 10-1716353 | 3/2017 |
| KR | 10-2018-0058950 | 6/2018 |
| KR | 10-2018-0062048 | 6/2018 |
| KR | 10-2018-0081320 | 7/2018 |
| KR | 10-1883925 | 8/2018 |

* cited by examiner

FIG. 7

| S1 | S2 | OUTPUT | SWITCH OPERATION |
|---|---|---|---|
| L | L | H | TURN-OFF |
| L | H | L | TURN-ON |
| H | L | L | TURN-ON |
| H | H | L | TURN-ON |

DISPLAY DEVICE AND POWER SETTING METHOD THEREOF

CROSS-REFERENCE TO RELATED APPLICATION

The application claims priority under 35 USC § 119 to and the benefit of Korean Patent Application No. 10-2021-0000556, filed Jan. 4, 2021, the disclosure of which is hereby incorporated by reference for all purposes as if fully set forth herein in its entirety.

FIELD

The present disclosure generally relates to display devices, and more particularly to a power controller and setting method thereof.

DISCUSSION

With developments in information technology, the importance of display devices as connecting mediums between users and information is emerging. In this regard, the use of display devices such as a liquid crystal display device and an organic light emitting display device is increasing.

A display device may include a display panel for displaying an image. In order to minimize power consumption, a display device may control a magnitude of a power supply voltage supplied to a display panel according to load values and grayscales of input data.

The degree of voltage drop, such as current times resistance (IR) drop, may be different for each display area according to the pattern of the image displayed by the display panel. For example, when the display panel displays an image having a partial white box pattern, more IR drop may occur in a relatively lower quality area (e.g., left and right end areas of the display panel), versus when the display panel displays a full white pattern. If the display device controls the magnitude of the power supply voltage without considering the IR drop, visibility quality of the displayed image may be low.

SUMMARY

An embodiment of the present disclosure may provide a display device that receives a feedback voltage of a power supply voltage from a relatively lower quality area and controls the magnitude of the power supply voltage through compensation for voltage or IR drop, thereby minimizing power consumption and minimizing or removing deterioration in visibility quality due to a change in luminance.

Embodiments of the present disclosure are not limited to the above-described embodiment, and may be variously extended without departing from the spirit and scope of the present disclosure.

A display device according to an embodiment of the present disclosure includes: a display panel having pixels arranged in a plurality of areas; a timing controller configured to generate image data based on input image data; a data driver configured to generate a data signal corresponding to the generated image data and supply the data signal to the pixels; a power supply configured to supply a first power supply voltage to the display panel; and a power controller configured to calculate a load value and a peak grayscale of the entire display panel based on the input image data, receive feedback voltages of the first power supply voltage from first areas of the plurality of areas in which voltage drop of the first power supply voltage occurs, and generate a power control signal for changing the level of the first power supply voltage based on the load value, the peak grayscale, and the feedback voltages.

The power controller may be configured to: calculate a first power code value or supply voltage value using the load value and the peak grayscale; when all of the feedback voltages are higher than a reference first power supply voltage, output a power control signal corresponding to the first power code value; when any one of the feedback voltages is lower than the reference first power supply voltage, increase the first power code value and re-receive feedback voltages from the relatively lower quality areas; and compare magnitudes of the re-received feedback voltages with a magnitudes of the reference first power supply voltage.

The relatively lower quality areas may include a first input terminal corresponding to one side of the display panel and a second input terminal corresponding to the other side of the display panel.

The power controller may include: a load value calculator configured to calculate the load value based on the input image data; a peak grayscale detector configured to detect the peak grayscale based on the input image data; and a power supply voltage generator configured to calculate the first power code value based on the load value and the peak grayscale.

The power controller may include a reference power supply voltage digital-to-analog converter configured to generate the reference first power supply voltage by using the first power code value and a preset first power correction code value.

The reference power supply voltage digital-to-analog converter may be configured to generate the reference first power supply voltage based on a value obtained by subtracting the first power correction code value from the first power code value.

The feedback voltages may include a first feedback voltage received from the first input terminal and a second feedback voltage received from the second input terminal.

The power controller may include: a first comparator configured to output a first feedback signal by comparing a magnitude of the reference first power supply voltage with a magnitude of the first feedback voltage; and a second comparator configured to output a second feedback signal by comparing the magnitude of the reference first power supply voltage with a magnitude of the second feedback voltage.

The first comparator may be configured to output the first feedback signal of a low level when the magnitude of the first feedback voltage is greater than or equal to the magnitude of the reference first power supply voltage, and output the first feedback signal of a high level when the magnitude of the first feedback voltage is less than the magnitude of the reference first power supply voltage.

The second comparator may be configured to output the second feedback signal of a low level when the magnitude of the second feedback voltage is greater than or equal to the magnitude of the reference first power supply voltage, and output the second feedback signal of a high level when the magnitude of the second feedback voltage is less than the magnitude of the reference first power supply voltage.

The display device may further include a switch between the power supply voltage generator and the reference power supply voltage digital-to-analog converter.

The switch may be configured to maintain a turned-on state when either of the first feedback signal and the second feedback signal is at a high level, and is configured to be turned off when both the first feedback signal and the second feedback signal are at a low level.

When the switch is turned off, the power supply may be configured to receive the power control signal from the power controller.

The power supply may include a power supply voltage digital-to-analog converter configured to provide, to the display panel, a corrected first power voltage corresponding to the power control signal.

The power supply may further include a converter configured to drop the voltage level of the corrected first power voltage between the power supply voltage digital-to-analog converter and the display panel.

The data driver may include a plurality of source driver ICs mounted on each of a plurality of flexible films, and one side of each of the flexible films is connected to one side of the display panel.

The other side of each of the flexible films may be connected to first printed circuit boards, part of the first printed circuit boards may be directly connected through a first connection portion to a second printed circuit board on which the power supply is mounted, and the others of the first printed circuit boards may be connected through a second connection portion to the part of the first printed circuit boards directly connected to the second printed circuit board.

The relatively lower quality areas may include a first input terminal of the first printed circuit board for supplying the first power supply voltage to a source driver IC relatively farther from the power supply in a first direction, and a second input terminal of the first printed circuit board for supplying the first power supply voltage to a source driver IC relatively farther from the power supply in a second direction.

Resistor dividers may be provided on one side of the first input terminal and one side of the second input terminal, and the power controller may be configured to receive feedback voltages of the first power supply voltage through the resistor dividers.

A power setting method of a display device including a display panel with a plurality of pixels, according to an embodiment of the present disclosure, includes: calculating a load value and a peak grayscale of the display panel based on input image data; receiving feedback voltages of a first power supply voltage from relatively lower quality areas in which IR drop of the first power supply voltage supplied to the display panel occurs relatively more frequently; and generating a power control signal for changing the level of the first power supply voltage based on the load value, the peak grayscale, and the feedback voltages.

The generating of the power control signal may include: calculating a first power code value using the load value and the peak grayscale; and compare magnitudes of the feedback voltages with a magnitude of a reference first power supply voltage.

The comparing of the magnitude of the voltage may include: when all of the feedback voltages are higher than a reference first power supply voltage, outputting, to the display panel, the power supply voltage corresponding to the first power code value; when any one of the feedback voltages is lower than the reference first power supply voltage, increasing the first power code value and re-receiving feedback voltages; and compare magnitudes of the re-received feedback voltages with a magnitudes of the reference first power supply voltage.

BRIEF DESCRIPTION OF THE DRAWINGS

FIG. 7 is a tabular diagram for describing an operation of a switch according to an embodiment.

DETAILED DESCRIPTION

Figure 1:
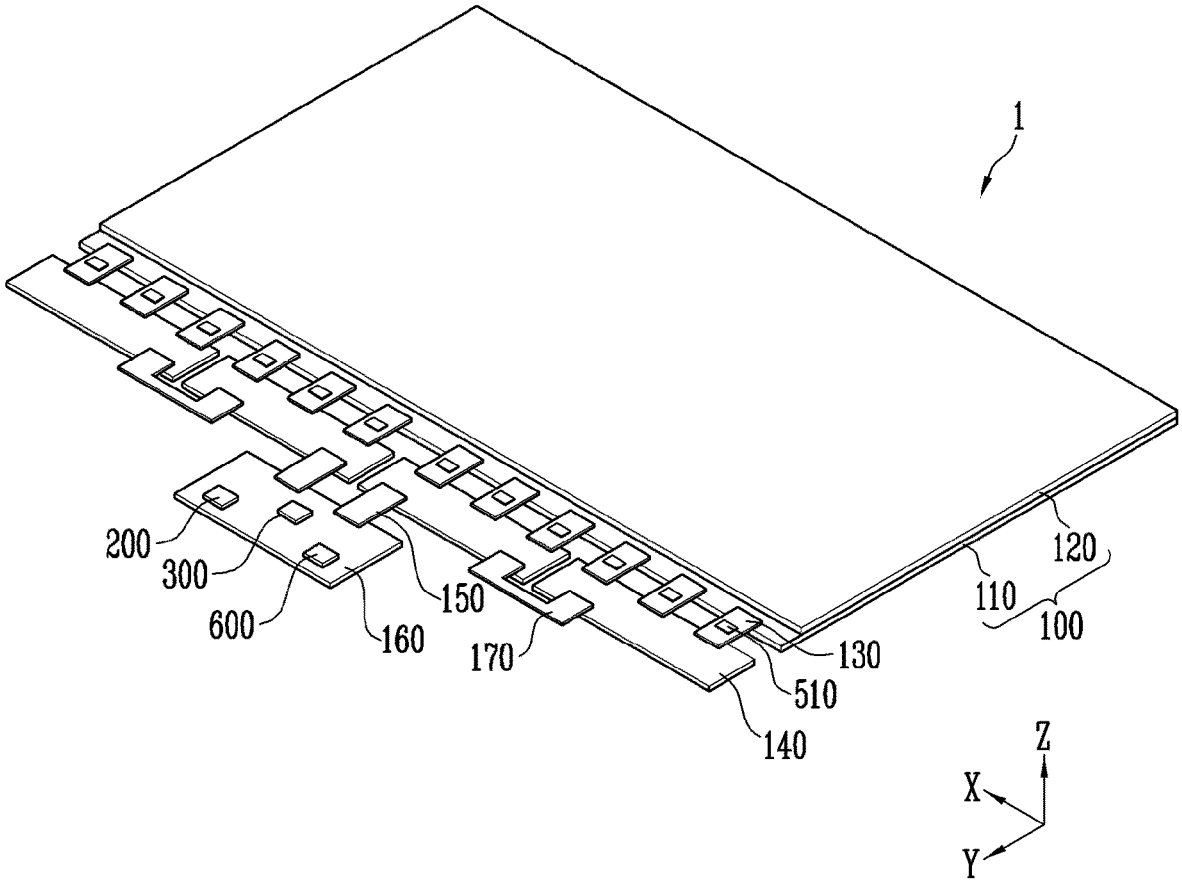
FIG. 1 is a perspective view diagram of a display device according to the present disclosure.

As the present description allows for various changes and numerous embodiments, a subset of these embodiments may be illustrated in the drawings and described in detail in the written description. However, this is not intended to limit the present disclosure to the specific forms disclosed herein, so it shall be understood that the claimed invention may include any or all changes, equivalents, and substitutes falling within the spirit and scope of the present disclosure.

In describing each drawing, similar reference numerals may be used for similar elements. In the accompanying drawings, the dimensions of the structures may be exaggerated for clarity. While such terms as "first" and "second" may be used to describe various elements, such elements shall not be limited by the above terms. For example, the above terms may be used merely to distinguish one element from another.

Figure 2:
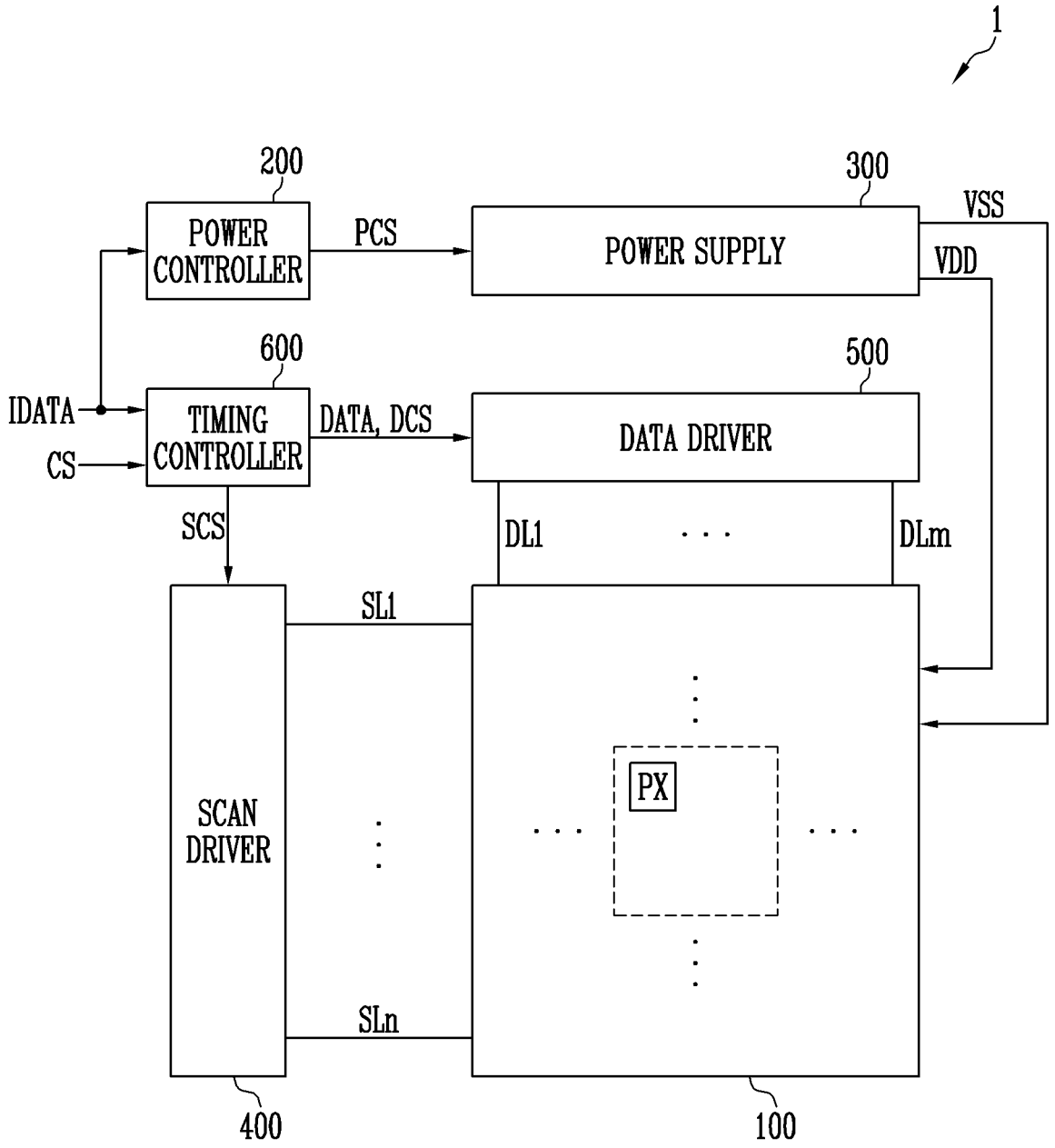
FIG. 2 is a block diagram of the display device according to the present disclosure.

FIG. 1 illustrates a display device according to the present disclosure. FIG. 2 illustrates the display device of FIG. 1.

Referring to FIGS. 1 and 2, the display device 1 may include a display panel 100, a power controller 200, a power supply 300, a scan driver 400, a data driver 500, and a timing controller 600. In FIG. 1, the power controller 200 is illustrated separately from the timing controller 600, but may be integrated with the timing controller 600 according to an embodiment. The display device 1 may further include a first printed circuit board (PCB) 140, a first connection portion 150, a second PCB 160, and a second connection portion 170 in order for connection between the timing controller 600 and source driver ICs 510 mounted on a flexible film 130.

Hereinafter, for convenience of description, it is assumed that the display device 1 is the organic light emitting display device 1. However, the present disclosure is not limited thereto, and may be applied to various types of display devices, such as a liquid crystal display device (LCD), an electrophoretic display (EPD), and an inorganic light emitting display device.

The display panel 100 may include a lower substrate 110 and an upper substrate 120. The lower substrate 110 may be a thin film transistor substrate including plastic or glass. The upper substrate 120 may be an encapsulation substrate including a plastic film, a glass substrate, or a protective film.

The lower substrate 110 may include a display area and a non-display area provided around the display area. The display area is an area in which pixels PX are provided to display an image. Scan lines SL1 to SLn (where n is a positive integer of 2 or more) and data lines DL1 to DLm (where m is a positive integer of 2 or more) may be disposed on the lower substrate 110. The data lines DL1 to DLm may be disposed to intersect with the scan lines SL1 to SLn.

The pixels PX may receive first power VDD and second power VSS (or power supply voltages) from the power supply 300. Here, the first power VDD and the second power VSS may be voltages required for the operation of the pixels PX. The first power VDD may have a voltage level higher than that of the second power VSS. For example, the first power VDD may be a positive voltage, and the second power VSS may be a negative voltage.

The scan driver 400 may receive a scan control signal SCS from the timing controller 600. The scan driver 400 may supply scan signals to the scan lines SL1 to SLn in response to the scan control signal SCS. The scan signals may include a scan signal and a sensing signal. The scan driver 400 may be formed in the non-display area outside one or both sides of the display area of the display panel 100 (or the lower substrate 110) in a gate driver in panel (GIP) scheme.

The data driver 500 may receive image data DATA and a data control signal DCS from the timing controller 600. According to an embodiment, the image data DATA may be image data received from a host system, or image data corrected by performing external compensation for compensating a threshold voltage of a driving transistor and after-image compensation for compensating the degree of deterioration of a light emitting element. The data driver 500 may convert the image data DATA into an analog data voltage according to the data control signal DCS and supply the analog data voltage to the data lines DL1 to DLm. Pixels PX to which data voltages are to be supplied may be selected by the scan signals supplied from the scan driver 400. The selected pixels PX may receive data voltages and emit light with a predetermined brightness.

As illustrated in FIG. 1, the data driver 500 may include a plurality of source driver integrated circuits (SDICs) 510. Each of the SDICs 510 may be mounted on each of the flexible films 130. Each of the flexible films 130 may be bonded to pads provided on the lower substrate 110 in a tape automated bonding (TAB) method using an anisotropic conductive film (ACF). Since the pads are connected to the data lines DL1 to DLm, the SDICs 510 may be connected to the data lines DL1 to DLm.

Each of the flexible films 130 may be provided by a chip on film (COF) process or a chip on plastic (COP) process. The chip on film may include a base film such as polyimide and a plurality of conductive signal lines provided on the base film. Each of the flexible films 130 may be foldable or bendable.

The SDICs 510 may be connected to each other by the first PCBs 140. The flexible films 130 may connect the first PCBs 140 to the lower substrate 110 of the display panel 100. The first PCB 140 may be a flexible PCB (FPCB).

The power controller 200, the power supply 300, and the timing controller 600 may be mounted on the second PCB 160. The second PCB 160 may be connected to the first PCB 140 through the first connection portion 150. The first PCB 140 that is not directly connected to the second PCB 160 through the first connection portion 150 may be connected to the adjacent first PCB 140 through the second connection portion 170. According to an embodiment, the power supply 300 may be disposed at substantially the same distance from the two first connection portions 150.

The first connection portion 150 and the second connection portion 170 may be a plurality of signal lines including a bus, which is an input/output terminal to which an intra interface is applied between the timing controller 600 and the SDIC 510. The intra interface is an interface capable of processing a plurality of input data at high speed. However, the present disclosure is not limited thereto, and the first connection portion 150 and the second connection portion 170 may be implemented as a plurality of signal lines including an arbitrary input/output terminal and an arbitrary interface capable of transmitting data.

The timing controller 600 may receive input image data IDATA and a control signal CS from the host system. For example, the host system may include a system on chip (SoC) in which a scaler is embedded. In this case, the input image data IDATA may include at least one image frame. In addition, the control signal CS may include a synchronization signal, a clock signal, and the like.

The control signal CS may include a vertical synchronization signal, a horizontal synchronization signal, a data enable signal, a dot clock, and the like. The vertical synchronization signal is a signal defining one frame period. The horizontal synchronization signal is a signal defining one horizontal period required to supply data voltages to pixels PX of one horizontal line of the display panel 100. The data enable signal is a signal defining a period in which valid data is input. The dot clock is a signal that is repeated in a predetermined short period.

In order to control the operation timing of the scan driver 400 and the data driver 500, the timing controller 600 may generate a scan control signal SCS for controlling the operation timing of the scan driver 400 and a data control signal DCS for controlling the operation timing of the data driver 500, based on the control signals CS. The timing controller 600 may output the scan control signal SCS to the scan driver 400 and may output the data control signal DCS to the data driver 500.

The power supply 300 may supply the first power VDD and the second power VSS to the pixels PX of the display panel 100. For example, the power supply 300 may receive an input voltage from the outside, generate the first power VDD and the second power VSS using the input voltage, and supply the first power VDD and the second power VSS to the display panel 100.

The power controller 200 may detect a peak grayscale among the grayscales of the input image data IDATA and calculate a load value corresponding to each image frame of the input image data IDATA. In this case, the relatively higher (e.g., highest) grayscale among the input image data IDATA in the image frame may be detected as the peak grayscale. In addition, the load value may be a value corresponding to the sum of grayscales of the image frame. For example, as the sum of grayscales of the image frame increases, the load value of the corresponding image frame may increase.

For example, a load value in a full-white image frame may be 100, and a load value in a full-black image frame may be 0. Here, the full-white image frame may refer to an image frame in which all pixels of the display panel 100 are set to the maximum grayscales (white grayscales) and emit light with maximum luminance. In addition, the full-black image frame may refer to an image frame in which all pixels of the display panel 100 are set to the relatively lower (e.g., lowest) grayscales (black grayscales) and do not significantly emit light. That is, the load value may have a value between 0 and 100.

The peak grayscale and the load value of the input image data IDATA may be different according to the display image.

Here, when the peak grayscale of the input image data IDATA is relatively high, the amount of driving current required for the display image may be relatively large. In addition, when the load value corresponding to the image frame of the input image data IDATA is relatively large, the amount of driving current required for the display image may be relatively large. In this case, the relatively high first power VDD may be required for the display image.

In contrast, when the peak grayscale of the input image data IDATA is relatively lower (e.g., lowest), the amount of driving current required for the display image may be relatively small. In addition, when the load value corresponding to the image frame of the input image data IDATA is relatively small, the amount of driving current required for the display image may be relatively small. In this case, even when the display device 1 supplies the relatively lower (e.g., lowest) first power VDD to the display panel 100, it is possible to sufficiently secure the amount of driving current required for the display image.

Meanwhile, the first power VDD supplied from the power supply 300 to the display panel 100 may cause IR drop (or voltage drop) due to the resistance of the lines while passing through the lines formed in the first PCB 140, the second PCB 160, and the first connection portion 150, and the second connection portion 170.

In general, the IR drop may increase in proportion to the length of the line. However, the degree of IR drop may be affected by the pattern of the image displayed on the display panel 100. For example, when the white box pattern in which the white image is displayed only in the left 20% area and the black image is displayed in the remaining area is displayed on the display panel 100, more IR drop may occur in the relatively lower (e.g., lowest) quality area (e.g., left and right end areas of the first PCB 140), as compared with the case in which the full white pattern is displayed on the display panel 100.

This is because, when the full white pattern is displayed, it is uniformly distributed to all display areas of the display panel 100 while the current corresponding to the first power VDD is supplied from the power supply 300 to the relatively lower (e.g., lowest) quality area, but, when the white box pattern is displayed only on the left side of the display panel 100, the current corresponding to the first power VDD flows only from the power supply 300 to the left side of the display panel 100, and while being supplied to the relatively lower (e.g., lowest) quality area (e.g., the left end area of the first PCB 140), it is uniformly distributed to the display areas of the display panel 100. That is, since the current is not supplied to the black image, more current flows through the white image displayed on the left 20%, resulting in occurrence of larger IR drop.

Therefore, when the display device 1 controls the magnitude of the first power VDD without considering the IR drop due to the pattern of the image displayed on the display panel 100, the visibility of the image displayed on the display panel 100 may be deteriorated.

Therefore, the power controller 200 may generate a power control signal PCS for controlling the voltage level of the first power VDD based on the peak grayscale of the input image data IDATA, the load value corresponding to the image frame of the input image data IDATA, and the IR drop according to the pattern of the image displayed on the display panel 100. For example, the power controller 200 may reduce the voltage level of the positive first power VDD, thereby reducing the voltage difference between the first power VDD and the second power VSS. Therefore, power consumption may be minimized.

Meanwhile, in the above description, the power controller 200 has been described based on controlling the voltage level of the first power VDD, but this is exemplary and the present disclosure is not limited thereto. For example, the power controller 200 may increase the voltage level of the negative second power VSS, thereby reducing the voltage difference between the first power VDD and the second power VSS. Hereinafter, for convenience of description, a description will be given based on a case in which the power controller 200 controls the voltage level of the first power VDD.

Figure 3:
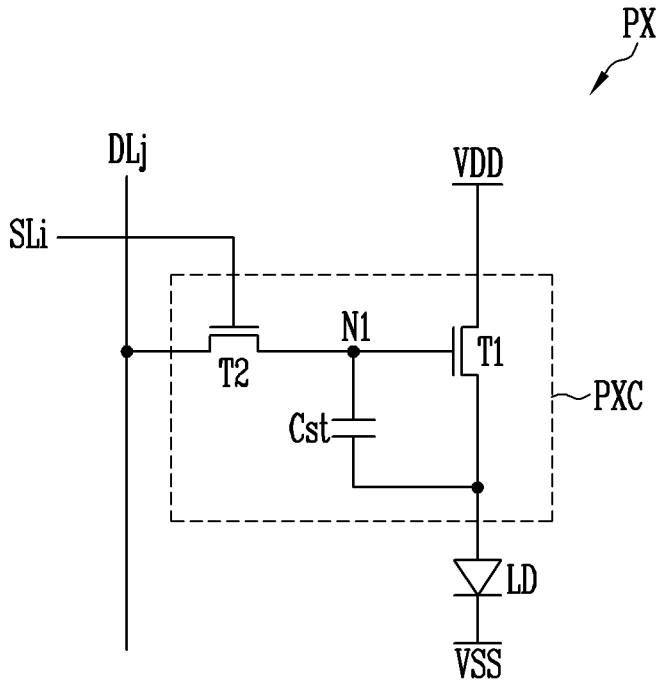
FIG. 3 is a circuit diagram illustrating an example of a pixel included in the display device of FIG. 1.

FIG. 3 illustrates an example of a pixel included in the display device of FIG. 1. For convenience of description, a pixel PX corresponding to an i-th row and a j-th column will be described.

Referring to FIG. 3, the pixel PX may include a light emitting element LD and a driving circuit PXC connected thereto to drive the light emitting element LD.

A first electrode (e.g., an anode electrode) of the light emitting element LD may be connected to the first power VDD via the driving circuit PXC, and a second electrode (e.g., a cathode electrode) of the light emitting element LD may be connected to the second power VSS. The light emitting element LD may emit light with a luminance corresponding to the amount of driving current controlled by the driving circuit PXC.

As the light emitting element LD, an organic light emitting diode may be selected. In addition, as the light emitting element LD, an inorganic light emitting diode such as a micro light emitting diode (LED) or a quantum dot light emitting diode may be selected. In addition, the light emitting element LD may be an element including organic and inorganic materials in combination. FIG. 3 illustrates that the pixel PX includes a single light emitting element LD, but in another embodiment, the pixel PX may include a plurality of light emitting elements, and the plurality of light emitting elements may be connected to each other in series, parallel, or series-parallel.

The first power VDD and the second power VSS may have different potentials. For example, a voltage applied through the first power VDD may be greater than a voltage applied through the second power VSS.

The driving circuit PXC may include a first transistor T1, a second transistor T2, and a storage capacitor Cst.

A first electrode of the first transistor T1 (driving transistor) may be connected to the first power VDD, and a second electrode thereof may be electrically connected to the first electrode (e.g., the anode electrode) of the light emitting element LD. A gate electrode of the first transistor T1 may be connected to a first node N1. The first transistor T1 may control the amount of driving current supplied to the light emitting element LD in response to the data signal supplied to the first node N1 through a data line DLj.

A first electrode of the second transistor T2 (switching transistor) may be connected to the data line DLj, and a second electrode thereof may be connected to the first node N1. A gate electrode of the second transistor T2 may be connected to a scan line SLi.

The second transistor T2 may be turned on when a scan signal of a voltage (e.g., a gate-on voltage) at which the second transistor T2 can be turned on is supplied from the scan line SLi, and may electrically connect the data line DLj to the first node N1. At this time, the data signal of the frame is supplied to the data line DLj. Therefore, the data signal may be transmitted to the first node N1. A voltage corresponding to the data signal transmitted to the first node N1 may be stored in the storage capacitor Cst.

One electrode of the storage capacitor Cst may be connected to the first node N1, and the other electrode thereof may be connected to the first electrode of the light emitting element LD. The storage capacitor Cst may be charged with the voltage corresponding to the data signal supplied to the first node N1, and the charged voltage may be maintained until the data signal of the next frame is supplied.

Meanwhile, for convenience of description, a relatively simple pixel PX is illustrated in FIG. 3, and the structure of the driving circuit PXC may be variously changed. For example, the driving circuit PXC may further include various transistors, such as a compensation transistor for compensating the threshold voltage of the first transistor T1, an initialization transistor for initializing the first node N1, and/or an emission control transistor for controlling the emission time of the light emitting element LD, and other circuit elements, such as a boosting capacitor for boosting the voltage of the first node N1.

In addition, although FIG. 3 illustrates that the transistors included in the driving circuit PXC, for example, the first and second transistors T1 and T2, are all N-type transistors, the present disclosure is not limited thereto. That is, at least one of the first and second transistors T1 and T2 included in the driving circuit PXC may be changed to a P-type transistor.

Figure 4:
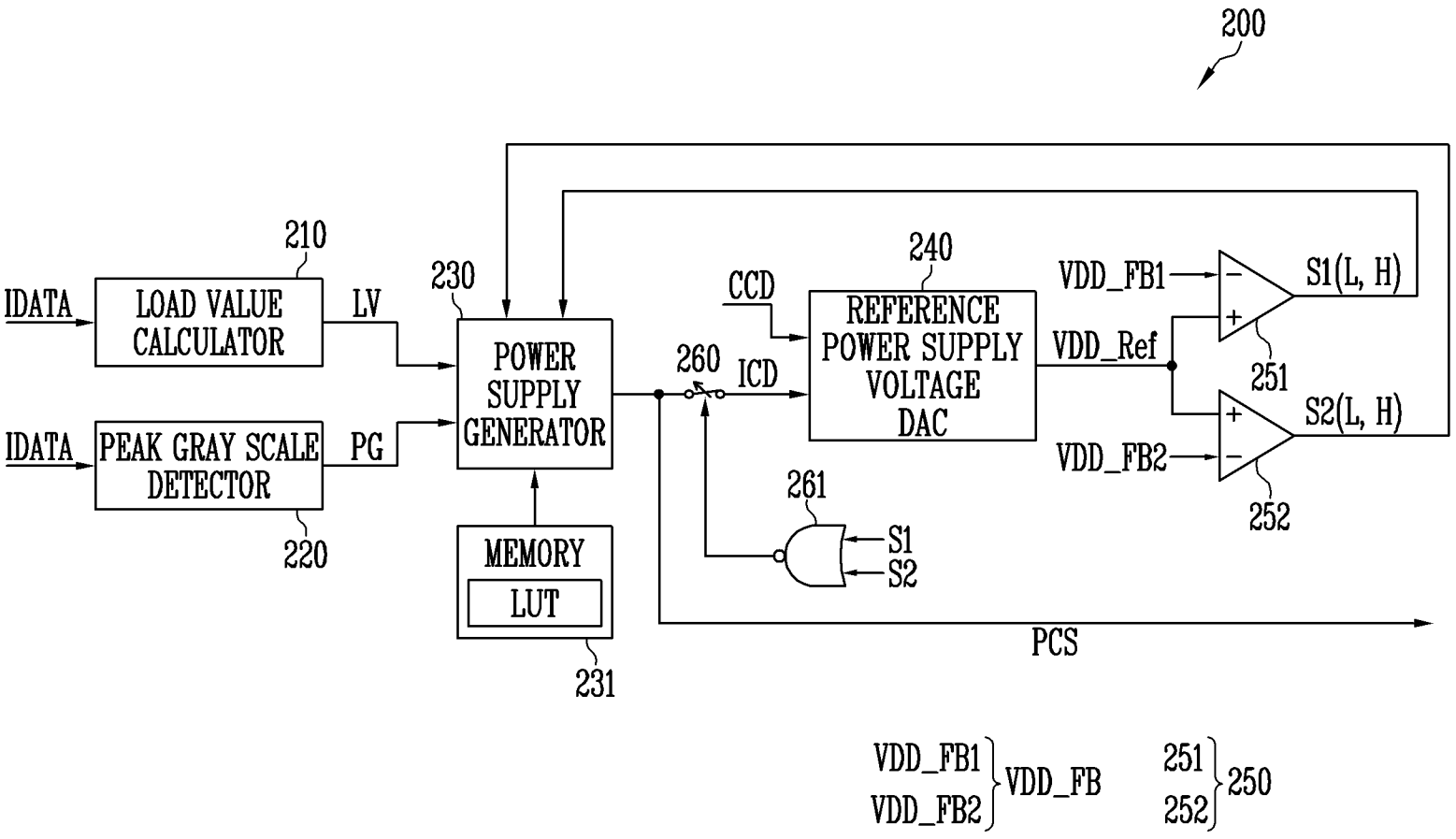
FIG. 4 is a block diagram for describing an operation of a power controller according to an embodiment.
Figure 5:
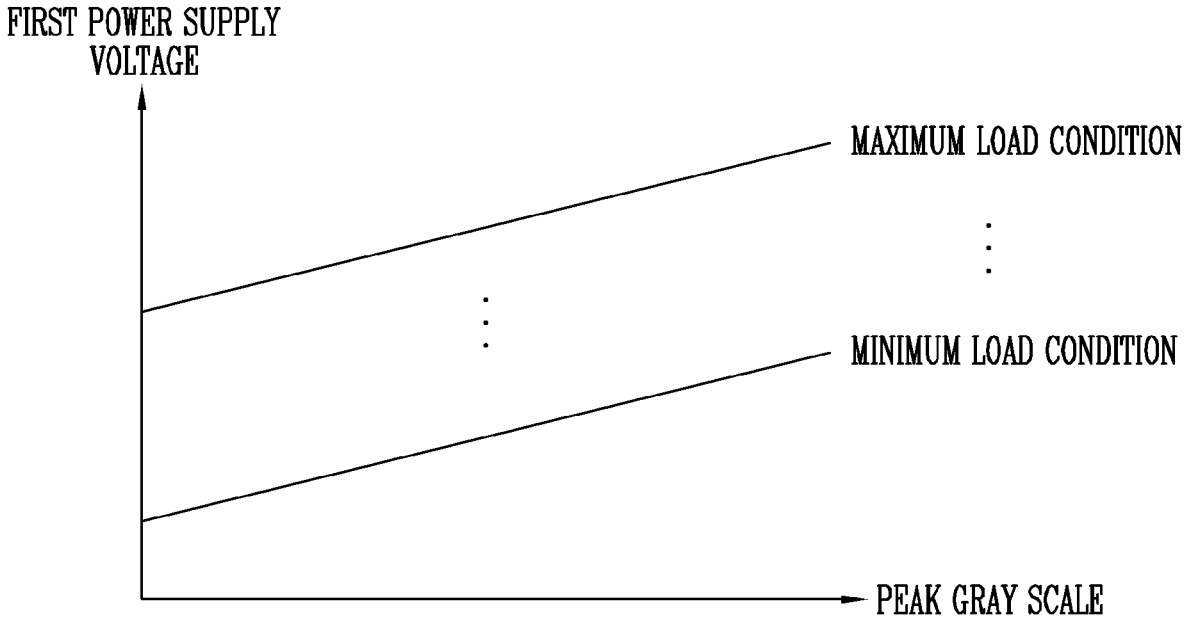
FIG. 5 is a graphical diagram for describing a voltage of a first power source according to a peak grayscale and a load value of input image data.
Figure 6:
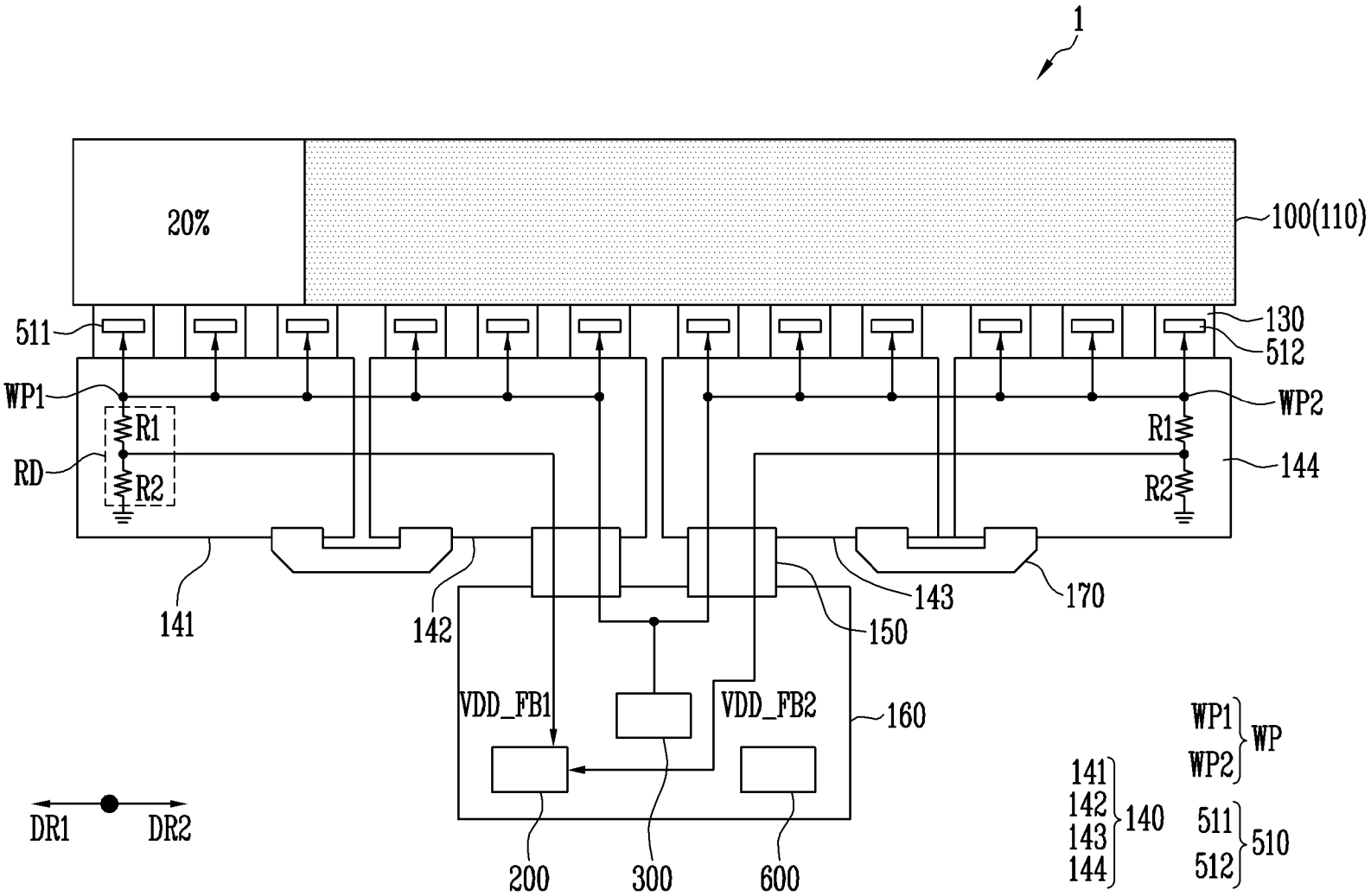
FIG. 6 is a plan view diagram illustrating one area of the display device illustrated in FIG. 1.
Figure 8:
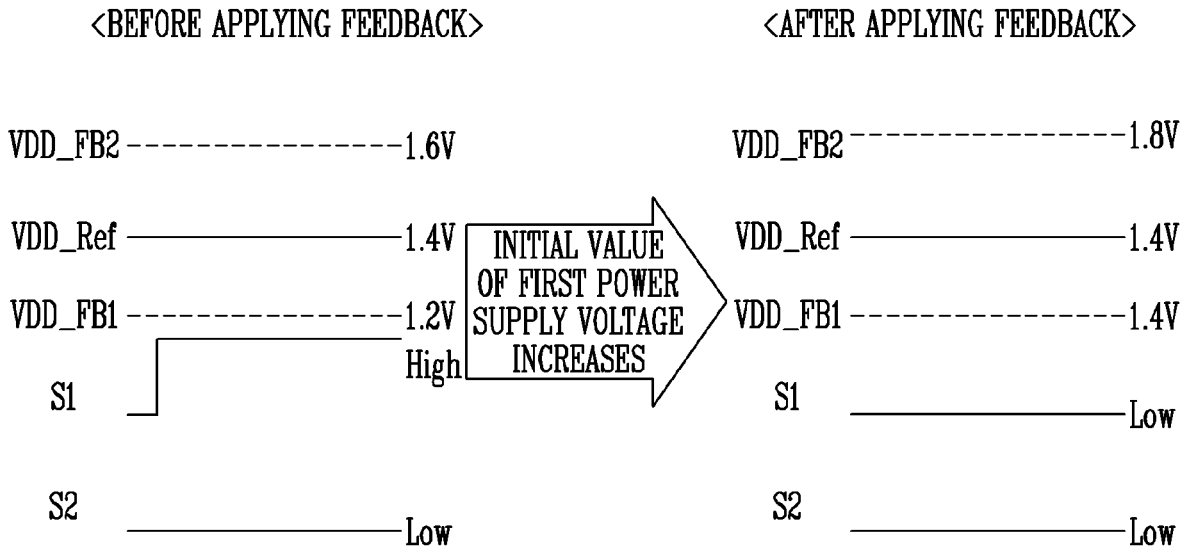
FIG. 8 is a hybrid diagram for describing an operation of a switch controller according to an embodiment.
Figure 9:
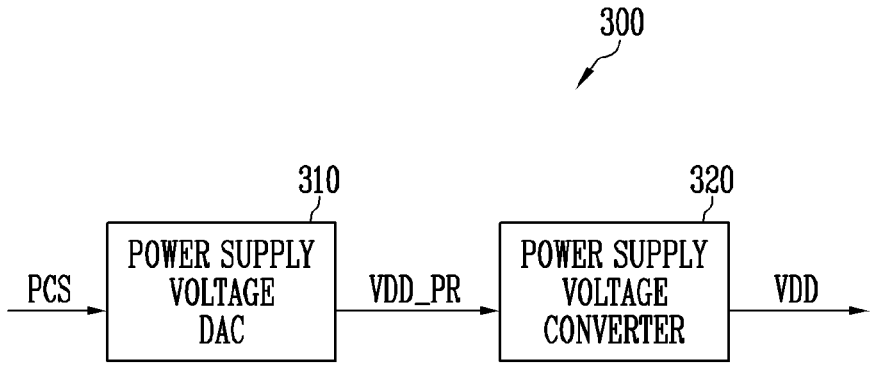
FIG. 9 is a block diagram for describing an operation of a power supply according to an embodiment.

FIG. 4 illustrates operation of a power controller according to an embodiment. FIG. 5 illustrates a voltage of first power according to a peak grayscale and a load value of input image data. FIG. 6 illustrates one area of the display device illustrated in FIG. 1. FIG. 7 illustrates an operation of a switch according to an embodiment. FIG. 8 illustrates an operation of a switch controller according to an embodiment. FIG. 9 illustrates an operation of a power supply according to an embodiment.

Referring to FIG. 4, the power controller 200 according to an embodiment may include a load value calculator 210, a peak grayscale detector 220, a power supply voltage generator 230, a reference power supply voltage digital-to-analog converter (DAC) 240, a comparator 250, and a switch 260.

The power controller 200 may calculate a first power code value ICD (or a power code value) using the load value LV and the peak grayscale PG based on the input image data IDATA, may receive feedback voltages VDD_FB from the relatively lower (e.g., lowest) quality areas in which the relatively more (e.g., most) (e.g., most) IR drop of the first power VDD occurs (e.g., a first input terminal WP1 and a second input terminal WP2 of the first PCB 140, see FIG. 6), and may output the power control signal PCS corresponding to the first power code value ICD when all of the feedback voltages VDD_FB are greater than a reference first power supply voltage VDD_Ref.

When either of the first feedback voltage VDD_FB1 and the second feedback voltage VDD_FB2 is lower than the reference first power supply voltage VDD_Ref, the power controller 200 may increase the first power code value ICD (e.g., add the code value of 1), may re-receive the feedback voltages VDD_FB1 and VDD_FB2 from the relatively lower (e.g., lowest) quality areas, and may re-compare the magnitudes of the re-received feedback voltages VDD_FB1 and VDD_FB2 with the reference first power supply voltage VDD_Ref. Hereinafter, the power controller 200 may repeat the above-described process until all of the feedback voltages VDD_FB are higher than the reference first power supply voltage VDD_Ref.

Specifically, the load value calculator 210 may calculate the load value LV representing the driving amount of the input image data IDATA based on the input image data IDATA. The load value LV may be proportional to the grayscale value of the input image data IDATA, and may be calculated from the input image data IDATA. In an embodiment, the load value calculator 210 may determine the load value LV using [Equation 1].

$$\text{Load Value}=Kr*\Sigma Ri+Kg*\Sigma Gi+Kb*\Sigma Bi \quad \text{[Equation 1]}$$

Here, Ri represents red image data included in the input image data IDATA, Gi represents green image data included in the input image data IDATA, Bi represents blue image data included in the input image data IDATA, Kr represents a gain value of red video data, Kg represents a gain value of green video data, and Kb represents a gain value of blue image data. Kr, Kg, and Kb may be experimentally adjusted in a range of greater than 0 and less than or equal to 1.

In an embodiment, the load value calculator 210 may calculate the load value LV for each predetermined frame period. When the frequency of sudden fluctuations in the load value LV of the input image data IDATA is small, the load value calculator 210 may calculate the load value LV for each predetermined frame period in order to reduce the load for calculating the load value LV. In addition, the load value calculator 210 may calculate the load value LV for each frame in order to accurately measure the load value LV.

The peak grayscale detector 220 may detect the peak grayscale PG based on the input image data IDATA. The peak grayscale detector 220 may detect the relatively higher (e.g., highest) grayscale among the input image data IDATA in the image frame as the peak grayscale.

The power supply voltage generator 230 may calculate the first power code value ICD based on the load value LV and the peak grayscale PG. The power supply voltage generator 230 may uses a lookup table LUT stored in the memory 231 to obtain the first power code value ICD (or the power voltage code value) of a digital form corresponding to the load value LV and the peak grayscale PG.

Referring to FIG. 5, the voltage of the first power VDD required for the display panel 100 to emit light with a target luminance is different according to the load value LV and the peak grayscale PG of the input image data IDATA. For example, the voltage level of the first power VDD may have a larger value as the total load value LV of the display panel 100 increases, and may have a larger value as the peak grayscale PG increases.

The memory 231 illustrated in FIG. 4 may store the voltages of the first power VDD corresponding to the load value LV of the input image data IDATA and the peak grayscale PG as the lookup table LUT. According to an embodiment, the lookup table LUT may include the first power code value ICD (or the power code value) corresponding to each of the magnitudes of the voltages of the first power VDD.

The reference power supply voltage DAC 240 may generate the reference first power supply voltage VDD_Ref by using the first power code value ICD and a preset first power correction code value CCD (or a power correction code value). According to an embodiment, the reference power supply voltage DAC 240 may generate the reference first power supply voltage VDD_Ref of an analog form corresponding to a value obtained by subtracting the first power correction code value CCD of a digital form from the first power code value ICD of a digital form. In this case, the first power correction code value CCD may be an arbitrary value. Therefore, the first power correction code value CCD may be set as a value for calculating the minimum first power VDD required for the display panel 100 to emit light with a target luminance. That is, after setting the first power VDD to the minimum, the power controller 200 may set the optimal first power VDD by reflecting the feedback voltages VDD_FB to be described later.

The comparator 250 may include a first comparator 251 that outputs a first feedback signal S1 by comparing the magnitude of the reference first power VDD_Ref with the magnitude of the first feedback voltage VDD_FB1, and a second comparator 252 that outputs a second feedback signal S2 by comparing the magnitude of the reference first power VDD_Ref with the magnitude of the second feedback voltage VDD_FB2.

Referring to FIG. 6, the data driver 500 (see FIG. 2) may include a plurality of SDICs 510 mounted on each of the plurality of flexible films 130, and one side of each of the flexible films 130 may be connected to one side of the display panel 100 (or the lower substrate 110, see FIG. 1). The other side of each of the flexible films 130 may be connected to the first PCBs 140, part 142 and 143 of the first PCBs 140 may be directly connected through the first connection portion 150 to the second PCB 160 on which the power supply 300 is mounted, and the others 141 and 144 of the first PCBs 140 may be connected through the second connection portion 170 to a portion of the first PCBs 142 and 143 directly connected to the second PCB 160.

The relatively lower (e.g., lowest) quality areas WP may include a first input terminal WP1 of the first PCB 141 that supplies the voltage of the first power VDD to the SDIC 511 relatively farther (e.g., farthest) from the power supply 300 in a first direction DR1, and a second input terminal WP2 of the first PCB 144 that supplies the voltage of the first power VDD to the SDIC 512 relatively farther from the power supply 300 in a second direction DR2.

The first PCB 141 may include a resistor divider RD on one side of the first input terminal WP1 and a resistor divider RD on one side of the second input terminal WP2. The power controller 200 may receive the first and second feedback voltages VDD_FB1 and VDD_FB2 through the resistor divider RD.

The resistor divider RD according to an embodiment may include a first resistor R1 and a second resistor R2 having different resistance values between the first input terminal WP1 and the ground node. Similarly, the resistor divider RD may include a first resistor R1 and a second resistor R2 having different resistance values between the second input terminal WP2 and the ground node, without limitation thereto. In this case, the resistance value of the first resistor R1 may be greater than the resistance value of the second resistor R2. Therefore, the magnitudes of the first and second feedback voltages VDD_FB1 and VDD_FB2 supplied to the power controller 200 may be reduced in a ratio of R2/(R1+R2). In an alternate embodiment, a resistor divider RD' may include a first resistor R1' and a second resistor R2' having different resistance values between the second input terminal WP2 and the ground node.

The first resistor R1 and the second resistor R2 have only to have resistance values such that no current flows from the first input terminal WP1 (or the second input terminal WP2) to the ground node. Accordingly, the power controller 200 may extract only the first feedback voltage VDD_FB1 (or the second feedback voltage VDD_FB2) from the first input terminal WP1 (or the second input terminal WP2).

Referring back to FIG. 4, the first comparator 251 may include a non-inverting input terminal that receives the reference first power supply voltage VDD_Ref from the reference power supply voltage DAC 240, an inverting input terminal that receives the first feedback voltage VDD_FB1 from the first input terminal WP1, and an output terminal that outputs the first feedback signal S1 generated by comparing the magnitudes of the reference first power voltage VDD_Ref with the first feedback voltage VDD_FB1.

According to an embodiment, when the first feedback voltage VDD_FB1 is higher than or equal to the reference first power supply voltage VDD_Ref, the first comparator 251 may output the first feedback signal S1 of a low level L, and when the first feedback voltage VDD_FB1 is lower than the reference first power supply voltage VDD_Ref, the first comparator 251 may output the first feedback signal S1 of a high level H. For example, referring to FIG. 7, when the first feedback voltage VDD_FB1 (for example, 1.2 [V]) is lower than the reference first power supply voltage VDD_Ref (for example, 1.4 [V]) before applying the feedback, the first comparator 251 may output the first feedback signal S1 of a high level H, and when the first feedback voltage VDD_FB1 (for example, 1.4 [V]) is higher than or equal to the reference first power supply voltage VDD_Ref (for example, 1.4 [V]) after applying the feedback, the first comparator 251 may output the first feedback signal S1 of a low level L.

Similarly, the second comparator 252 may include a non-inverting input terminal that receives the reference first power supply voltage VDD_Ref from the reference power supply voltage DAC 240, an inverting input terminal that receives the second feedback voltage VDD_FB2 from the second input terminal WP2, and an output terminal that outputs the second feedback signal S2 by comparing the magnitudes of the reference first power voltage VDD_Ref with the second feedback voltage VDD_FB2.

According to an embodiment, when the second feedback voltage VDD_FB2 is higher than or equal to the reference first power supply voltage VDD_Ref, the second comparator 252 may output the second feedback signal S2 of a low level L, and when the second feedback voltage VDD_FB2 is lower than the reference first power supply voltage VDD_Ref, the second comparator 252 may output the second feedback signal S2 of a high level H. For example, referring to FIG. 7, when the second feedback voltage VDD_FB2 (for example, 1.6 [V]) is higher than or equal to the reference first power supply voltage VDD_Ref (for example, 1.4 [V]) before applying the feedback, the second comparator 252 may output the second feedback signal S2 of a low level L. Since the second feedback voltage VDD_FB2 (for example, 1.8 [V]) is higher than the reference first power supply voltage VDD_Ref (for example, 1.4 [V]) even after applying the feedback, the second comparator 252 may maintain the second feedback signal S2 of a low level L.

Referring back to FIG. 4, a switch 260 may be further included between the power supply voltage generator 230 and the reference power supply voltage DAC 240. The switch 260 may include a switch controller 261 that controls opening and closing of the switch 260.

The switch controller 261 according to an embodiment may be configured with a NOR gate. Referring to the truth table illustrated in FIG. 7, when any one of the first feedback signal S1 and the second feedback signal S2 is at a high level H, the switch 260 may maintain a turned-on state, and when both the first feedback signal S1 and the second feedback signal S2 are at a low level L, the switch 260 may be turned off.

When the switch 260 is turned off, the power supply voltage generator 230 may output the power control signal PCS. In this case, the power control signal PCS may be the first power code value ICD of a digital form calculated by the power supply voltage generator 230.

Meanwhile, when the switch 260 maintains the turned-on state, the power supply voltage generator 230 may increase the first power code value ICD (e.g., may add the code value of 1). In this case, as the magnitude of the first power code value ICD increases, the voltage of the first power VDD provided to the display panel 100 may increase in proportion. Therefore, when the first power code value ICD is changed, the magnitude of the first feedback voltage VDD_FB1 re-received from the first input terminal WP1 (see FIG. 6) and the magnitude of the second feedback voltage VDD_FB2 re-received from the second input terminal WP2 (see FIG. 6) may also increase in proportion.

When the re-received first feedback voltage VDD_FB1 is higher than or equal to the reference first power supply voltage VDD_Ref, the first comparator 251 may output the first feedback signal S1 of a low level L, and when the re-received first feedback voltage VDD_FB1 is lower than the reference first power supply voltage VDD_Ref, the first comparator 251 may output the first feedback signal S1 of a high level H.

Similarly, when the re-received second feedback voltage VDD_FB2 is higher than or equal to the reference first power supply voltage VDD_Ref, the second comparator 252 may output the second feedback signal S2 of a low level L, and when the re-received second feedback voltage VDD_FB2 is lower than the reference first power supply voltage VDD_Ref, the second comparator 252 may output the second feedback signal S2 of a high level H.

Hereinafter, the power controller 200 may repeat the above-described process until both the first and second feedback voltages VDD_FB are higher than or equal to the reference first power supply voltage VDD_Ref. In other words, the power controller 200 may repeat the process of increasing the first power code value ICD (e.g., adding the code value of 1) until the first feedback signal S1 of the low level L and the second feedback signal S2 of the low level L are input to the switch controller 261.

Referring to FIG. 9, the power supply 300 may include a power supply voltage DAC 31 that provides the corrected first power VDD to the display panel 100 in response to the power control signal PCS (see FIG. 2). The power supply 300 may further include a power supply voltage converter 320 that converts the magnitude of the voltage of the first power VDD corrected between the power supply voltage DAC 310 and the display panel 100 into a magnitude suitable for operating the pixels PX included in the display panel 100.

According to an embodiment, the magnitude of an original first power supply voltage VDD_PR output from the power supply voltage DAC 310 may not be suitable for operating the pixels PX included in the display panel 100. For example, the magnitude of the original first power supply voltage VDD_PR may be larger than the magnitude of the voltage of the corrected first power VDD. Accordingly, the power supply voltage converter 320 may be a buck converter that drops the input voltage. That is, the power supply voltage converter 320 may drop the original first power supply voltage VDD_PR having a relatively large value to the voltage of the corrected first power VDD having a value suitable for operating the pixels PX included in the display panel 100.

Figure 10A:
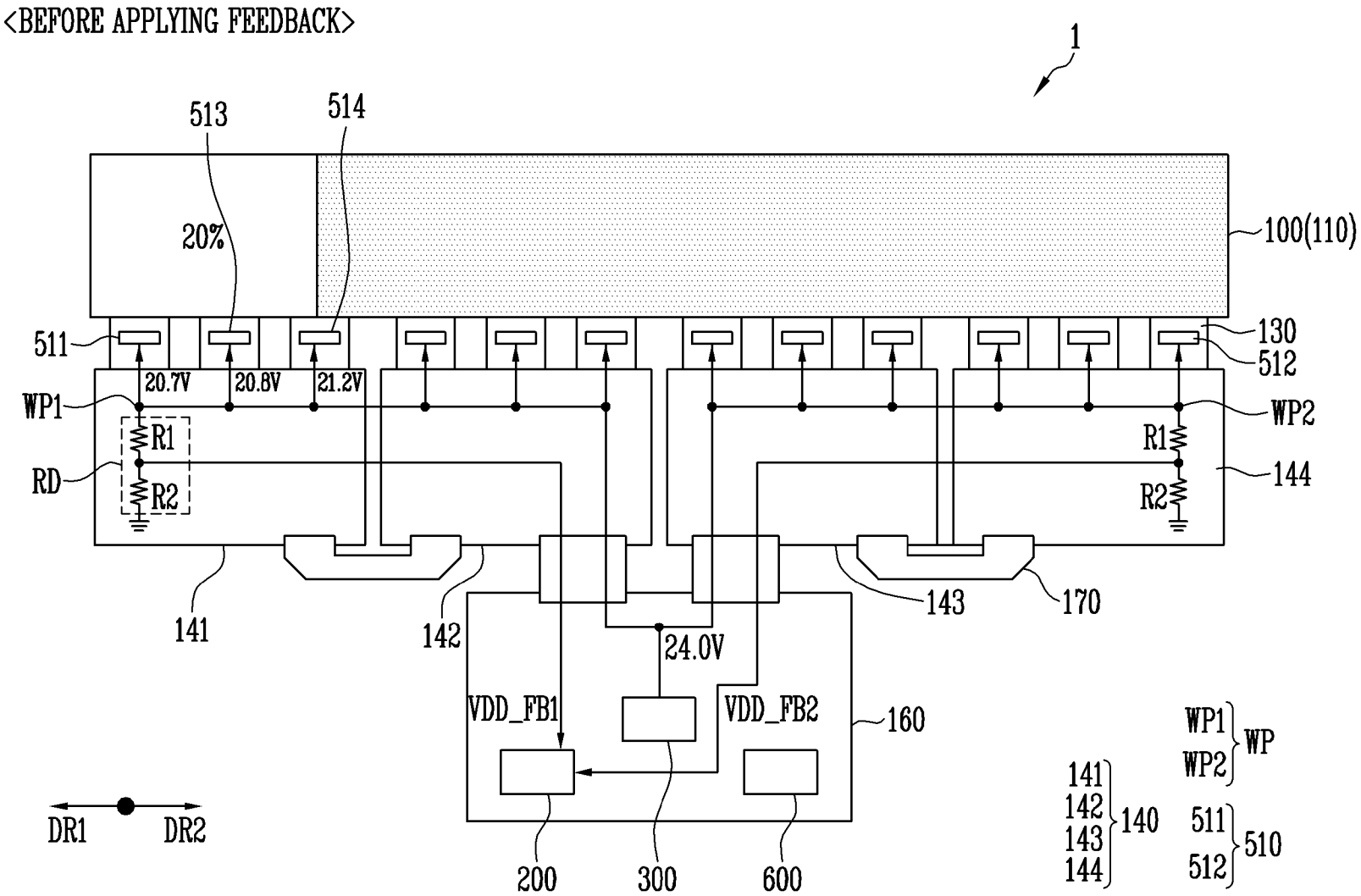
FIGS. 10A and 10B are plan view diagrams for describing a display device according to an embodiment of the present disclosure.
Figure 10B:
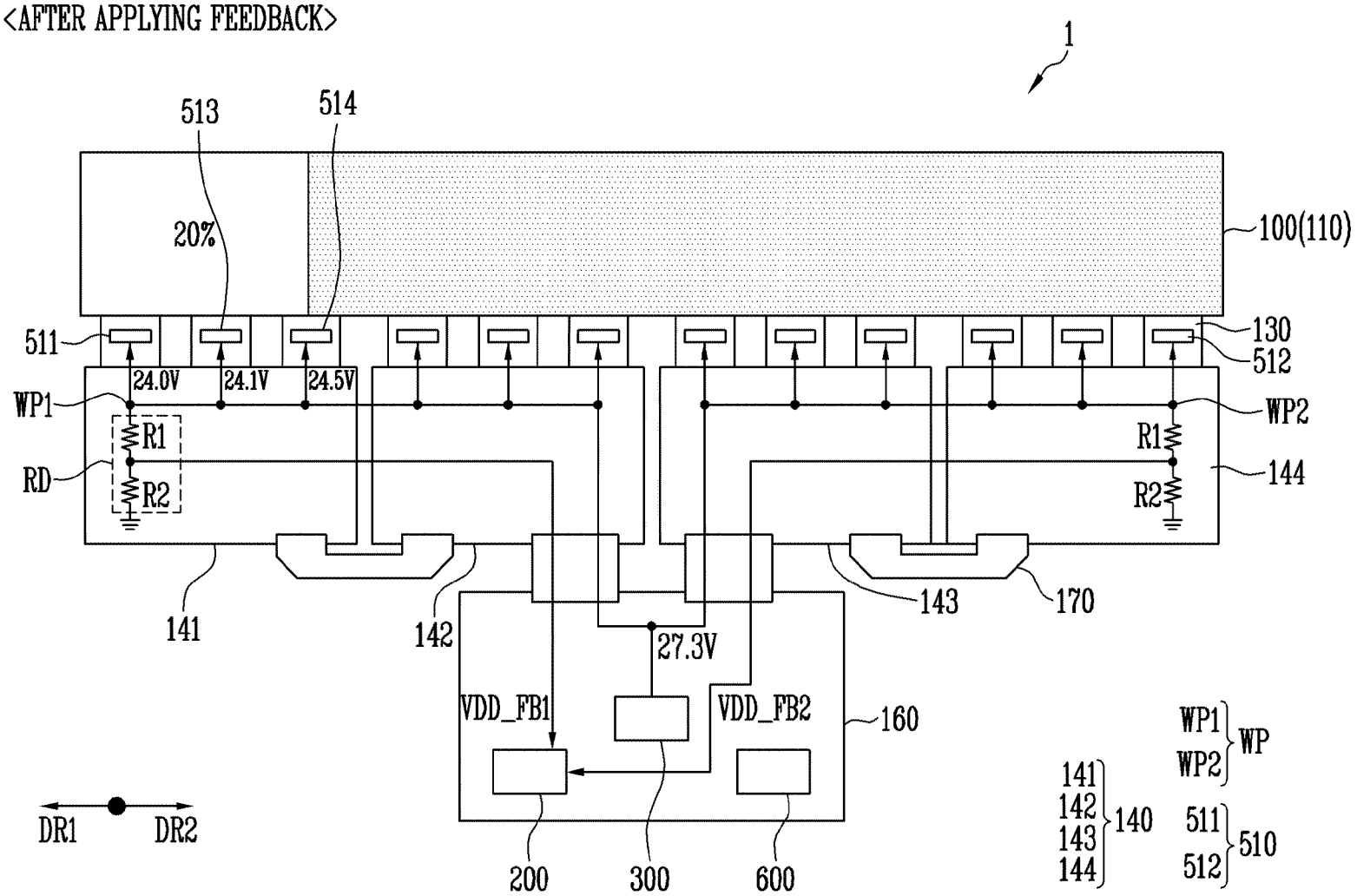

FIGS. 10A and 10B illustrate a display device before and after applying feedback, respectively, according to an embodiment of the present disclosure.

Referring to FIGS. 2, 4, and 10A, in the display device 1 according to an embodiment, the white box pattern in which the white image is displayed only in the left 20% area and the black image is displayed in the remaining area may be displayed on the display panel 100.

In this case, the power controller 200 may calculate the load value LV and the peak grayscale PG based on the input image data IDATA, and generate the power control signal PCS for controlling the voltage level of the first power VDD based on the calculated load value LV and peak grayscale PG. For example, the magnitude of the voltage of the first power VDD corresponding to the power control signal PCS may be 24.0 [V].

In general, the IR drop may increase in proportion to the length of the line. However, the degree of IR drop may be affected by the pattern of the image displayed on the display panel 100. For example, when the white box pattern is displayed only on the left side of the display panel 100, the current corresponding to the voltage of the first power VDD flows only from the power supply 300 to the left side of the display panel 100, and may be unevenly distributed to the display areas of the display panel 100 while being supplied to the first input terminal WP1. That is, since the current is not supplied to the black image, more current flows through the white image displayed on the left 20%, resulting in occurrence of larger IR drop.

As a result, the voltage of the first power VDD supplied to each of the SDICs 514, 513, and 511 corresponding to the white image displayed on the left 20% area may be sequentially decreased to 21.2 [V], 20.8 [V], and 20.7 [V]. Therefore, the first transistor T1 (driving transistor, see FIG. 3) included in the pixels PX (see FIG. 3) corresponding to the white image displayed on the left 20% area may operates in a linear region, and thus the screen luminance may be sequentially reduced. That is, the visibility of the image displayed on the display panel 100 may be deteriorated.

Meanwhile, referring to FIGS. 2, 4, and 10B, the power controller 200 may receive the first feedback voltage VDD_FB1 from the first input terminal WP1 and may receive the second feedback voltage VDD_FB2 from the second input terminal WP2. The power controller 200 may compare the first feedback voltage VDD_FB1 with the reference first power supply voltage VDD_Ref, may compare the second feedback voltage VDD_FB2 with the reference first power supply voltage VDD_Ref, and may increase the first power code value ICD proportional to the voltage of the first power VDD until both the first feedback voltage VDD_FB1 and the second feedback voltage VDD_FB2 are higher than or equal to the reference first power supply voltage VDD_Ref.

When both the first feedback voltage VDD_FB1 and the second feedback voltage VDD_FB2 are higher than or equal to the reference first power supply voltage VDD_Ref, the power controller 200 may provide the power control signal PCS to the power supply 300. The power supply 300 may provide the voltage of the corrected first power VDD to the display panel 100 (see FIG. 2) in response to the power control signal PCS.

In this case, the voltage of the corrected first power VDD may be higher than the voltage of the first power VDD before the correction. For example, the voltage level of the corrected first power VDD may be 27.3 [V]. As a result, even when IR drop occurs, the voltage of the first power VDD supplied to each of the SDICs 514, 513, and 511 corresponding to the white image displayed on the left 20% area may be sequentially decreased to 24.5 [V], 24.1 [V], and 24.0 [V].

Therefore, the first transistor T1 (driving transistor, see FIG. 3) included in the pixels PX (see FIG. 3) corresponding to the white image displayed on the left 20% area may operates in a saturation region, and thus the screen luminance may be uniform. That is, the visibility of the image displayed on the display panel 100 may be improved.

Figure 11:
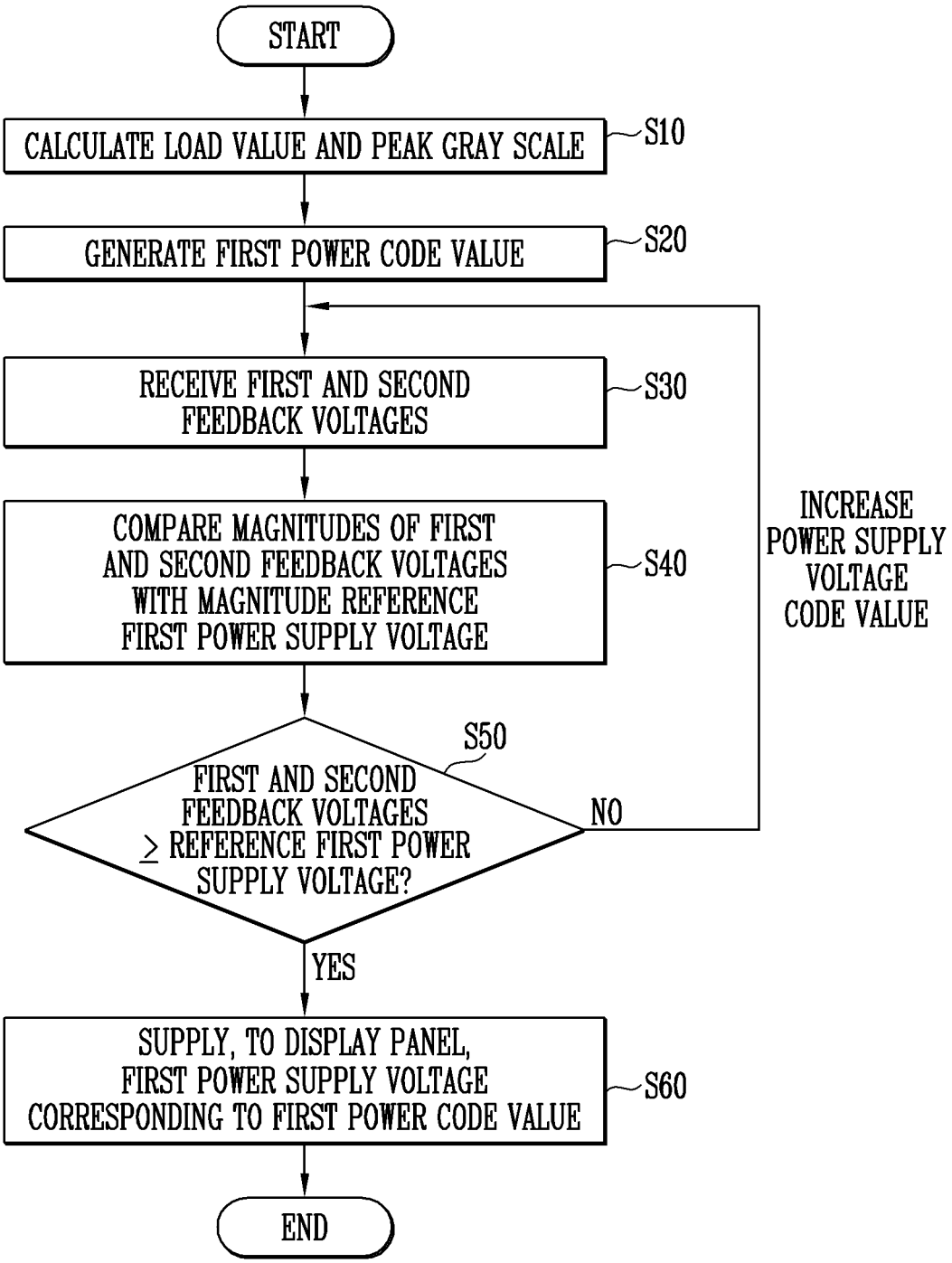
FIG. 11 is a flowchart diagram for describing a method of setting a power supply voltage in a display device according to an embodiment of the present disclosure.

FIG. 11 illustrates a method of setting a power supply voltage in a display device according to an embodiment of the present disclosure.

Referring to FIGS. 1 to 11, the display device 1 may adaptively set the voltage of the first power VDD (or the power supply voltage) supplied to the display panel 100 considering the load value LV, the peak grayscale PG, and the first and second feedback voltages VDD_FB1 and VDD_FB2 of the first power VDD (or the power supply voltage) received from the relatively lower (e.g., lowest) quality areas (or, the first input terminal WP1 and the second input terminal WP2), wherein the load value LV, the peak grayscale PG, and the first and second feedback voltages VDD_FB1 and VDD_FB2 are provided to the display panel 100.

First, the display device 1 may calculate the load value LV and the peak grayscale PG of the display panel 100 based on the input image data IDATA (S10).

The load value calculator 210 may calculate the load value LV representing the driving amount of the input image data IDATA based on the input image data IDATA. The load value LV may be proportional to the grayscale value of the input image data IDATA, and may be calculated from the input image data IDATA. In addition, the peak grayscale detector 220 may detect the peak grayscale PG based on the input image data IDATA. The peak grayscale detector 220 may detect the relatively higher (e.g., highest) grayscale among the input image data IDATA in the image frame as the peak grayscale.

After that, the display device 1 may calculate the first power code value ICD using the load value LV and the peak grayscale PG (S20).

The power supply voltage generator 230 may calculate the first power code value ICD based on the load value LV and the peak grayscale PG. The power supply voltage generator 230 may uses a lookup table LUT stored in the memory 231 to obtain the first power code value ICD (or the power voltage code value) of a digital form corresponding to the load value LV and the peak grayscale PG.

After that, the display device 1 may receive the feedback voltages VDD_FB1 and VDD_FB2 of the first power VDD may be received from the relatively lower (e.g., lowest) quality areas WP in which IR drop of the first power VDD (or the power supply voltage) supplied to the display panel 100 occurs relatively more (e.g., most) frequently (S30).

The relatively lower (e.g., lowest) quality areas WP may include a first input terminal WP1 of the first PCB 141 that supplies the voltage of the first power VDD to the SDIC 511 relatively farther from the power supply 300 in a first direction DR1, and a second input terminal WP2 of the first PCB 144 that supplies the voltage of the first power VDD to the SDIC 512 relatively farther from the power supply 300 in a second direction DR2.

After that, the display device 1 may compare the magnitude of the first feedback voltage VDD_FB1 with the magnitude of the reference first power supply voltage VDD_Ref, and may compare the magnitude of the second feedback voltage VDD_FB2 with the magnitude of the reference first power supply voltage VDD_Ref (S40).

The reference power supply voltage DAC 240 may generate the reference first power supply voltage VDD_Ref by using the first power code value ICD and the preset first power correction code value CCD (or the power correction code value). According to an embodiment, the reference power supply voltage DAC 240 may generate the reference first power supply voltage VDD_Ref of an analog form corresponding to a value obtained by subtracting the first power correction code value CCD of a digital form from the first power code value ICD of a digital form. In this case, the first power correction code value CCD may be an arbitrary value.

When the first feedback voltage VDD_FB1 is higher than or equal to the reference first power supply voltage VDD_Ref, the first comparator 251 may output the first feedback signal S1 of a low level L, and when the first feedback voltage VDD_FB1 is lower than the reference first power supply voltage VDD_Ref, the first comparator 251 may output the first feedback signal S1 of a high level H.

Similarly, when the second feedback voltage VDD_FB2 is higher than or equal to the reference first power supply voltage VDD_Ref, the second comparator 252 may output the second feedback signal S2 of a low level L, and when the second feedback voltage VDD_FB2 is lower than the reference first power supply voltage VDD_Ref, the second comparator 252 may output the second feedback signal S2 of a high level H.

After that, when both the first feedback voltage VDD_FB1 and the second feedback voltage VDD_FB2 are higher than or equal to the reference first power supply voltage VDD_Ref, the display device 1 may supply, to the display panel 100, the voltage of the first power VDD corresponding to the first power code value ICD (S60).

A switch 260 may be further included between the power supply voltage generator 230 and the reference power supply voltage DAC 240. The switch 260 may include a switch controller 261 that controls opening and closing of the switch 260.

The switch controller 261 according to an embodiment may be configured with a NOR gate. When both the first feedback signal S1 and the second feedback signal S2 are at the low level L, the switch 260 may be turned off. When the switch 260 is turned off, the power supply voltage generator 230 may output the power control signal PCS to the power supply 300. In this case, the power control signal PCS may be the first power code value ICD of a digital form calculated by the power supply voltage generator 230.

The power supply 300 may include a power supply voltage DAC 310 that provides the corrected first power VDD to the display panel 100 in response to the power control signal PCS (see FIG. 2). The power supply 300 may further include a power supply voltage converter 320 that converts the magnitude of the voltage of the first power VDD corrected between the power supply voltage DAC 310 and the display panel 100 into a magnitude appropriate for operating the pixels PX included in the display panel 100.

Meanwhile, in the display device 1, when either of the first feedback signal S1 and the second feedback signal S2 is lower than the reference first power supply voltage VDD_Ref, that is, when either of the first feedback signal S1 and the second feedback signal S2 is at a high level H, the switch 260 may maintain the turned-on state.

When the switch 260 maintains the turned-on state, the power supply voltage generator 230 may increase the first power code value ICD (e.g., may add the code value of 1). In this case, as the magnitude of the first power code value ICD increases, the voltage of the first power VDD provided to the display panel 100 may increase in proportion. Therefore, when the first power code value ICD is changed, the magnitude of the first feedback voltage VDD_FB1 re-received from the first input terminal WP1 (see FIG. 6) and the magnitude of the second feedback voltage VDD_FB2 re-received from the second input terminal WP2 (see FIG. 6) may also increase in proportion.

Hereinafter, the power controller 200 may repeat the above-described process until both the first and second feedback voltages VDD_FB are higher than the reference first power supply voltage VDD_Ref. In other words, the power controller 200 may repeat the process of increasing the first power code value ICD (e.g., adding the code value of 1) until the first feedback signal S1 of the low level L and the second feedback signal S2 of the low level L are input to the switch controller 261.

The display device according to an embodiment of the present disclosure may receive the feedback voltage of the power supply voltage from the relatively lower (e.g., lowest) quality area and control the magnitude of the power supply voltage through compensation for IR drop, thereby minimizing power consumption and minimizing (removing) a deterioration in visibility due to a change in luminance.

However, embodiments of the present disclosure are not limited to the above-described embodiments, and may be variously extended without departing from the spirit and scope of the present disclosure.

The above detailed description is intended to illustrate and describe the present disclosure. In addition, the above description is provided to show and describe preferred exemplary embodiments of the present disclosure. As will be understood by those of ordinary skill in the pertinent art, the present disclosure can be used in or with various other combinations, changes and environments. Changes or modifications may be made thereto within the scope of the concept disclosed in the present specification, within the scope equivalent to the disclosed contents, and/or within the skill or knowledge of the art. Therefore, the detailed description of the disclosure is not intended to limit the claimed invention to the particularly described embodiments. Rather, the appended claims should be construed as including all embodiments.

What is claimed is:

1. A display device comprising:

a display panel including pixels arranged in a plurality of areas;

a timing controller configured to generate image data based on input image data;

a data driver configured to generate a data signal corresponding to the generated image data and supply the data signal to the pixels;

a power supply configured to supply a first power supply voltage to the display panel; and a power controller configured to calculate a load value and a peak grayscale of the entire display panel based on the input image data, receive feedback voltages of the first power supply voltage from first areas of the plurality of areas in which voltage drop of the first power supply voltage occurs, and generate a power control signal for changing the level of the first power supply voltage based on the load value, the peak grayscale, and the feedback voltages, wherein the power controller is configured to:

calculate a first power code value or supply voltage value using the load value and the peak grayscale;

when substantially all of the feedback voltages are higher than the reference first power supply voltage, output a power control signal corresponding to the first power code value;

when any one of the feedback voltages is lower than the reference first power supply voltage, increase the first power code value and re-receive feedback voltages from the first areas; and compare magnitudes of the re-received feedback voltages with a magnitude of the reference first power supply voltage.

2. The display device of claim 1, wherein the power controller is configured to correct the power control signal based on a proportion of the feedback voltages that deviate from a reference first power supply voltage, and to output the corrected power control signal.

3. The display device of claim 1, wherein the first areas include a first input terminal corresponding to one side of the display panel and a second input terminal corresponding to the other side of the display panel.

4. The display device of claim 3, wherein the power controller includes:

a load value calculator configured to calculate the load value based on the input image data;

a peak grayscale detector configured to detect the peak grayscale based on the input image data; and a power supply voltage generator configured to calculate the first power code value based on the load value and the peak grayscale.

5. The display device of claim 4, wherein the power controller includes a reference power supply voltage digital-to-analog converter configured to generate the reference first power supply voltage by using the first power code value and a preset first power correction code value.

6. The display device of claim 5, wherein the reference power supply voltage digital-to-analog converter is configured to generate the reference first power supply voltage based on a value obtained by subtracting the first power correction code value from the first power code value.

7. The display device of claim 4, wherein the feedback voltages include a first feedback voltage received from the first input terminal and a second feedback voltage received from the second input terminal.

8. The display device of claim 7, wherein the power controller includes:

a first comparator configured to output a first feedback signal by comparing a magnitude of the reference first power supply voltage with a magnitude of the first feedback voltage; and a second comparator configured to output a second feedback signal by comparing the magnitude of the reference first power supply voltage with a magnitude of the second feedback voltage.

9. The display device of claim 8, wherein the first comparator is configured to output the first feedback signal of a low level when the magnitude of the first feedback voltage is greater than or equal to the magnitude of the reference first power supply voltage, and output the first feedback signal of a high level when the magnitude of the first feedback voltage is less than the magnitude of the reference first power supply voltage, and the second comparator is configured to output the second feedback signal of a low level when the magnitude of the second feedback voltage is greater than or equal to the magnitude of the reference first power supply voltage, and output the second feedback signal of a high level when the magnitude of the second feedback voltage is less than the magnitude of the reference first power supply voltage.

10. The display device of claim 9, further comprising a switch between the power supply voltage generator and the reference power supply voltage digital-to-analog converter.

11. The display device of claim 10, wherein the switch is configured to maintain a turned-on state when either of the first feedback signal and the second feedback signal is at a high level, and is configured to be turned off when both the first feedback signal and the second feedback signal are at a low level.

12. The display device of claim 11, wherein, when the switch is turned off, the power supply is configured to receive the power control signal from the power controller.

13. The display device of claim 1, wherein the power supply includes a power supply voltage digital-to-analog converter configured to provide, to the display panel, a corrected first power voltage corresponding to the power control signal.

14. A display device comprising:

a display panel including pixels arranged in a plurality of areas;

a timing controller configured to generate image data based on input image data;

a data driver configured to generate a data signal corresponding to the generated image data and supply the data signal to the pixels;

a power supply configured to supply a first power supply voltage to the display panel; and a power controller configured to calculate a load value and a peak grayscale of the entire display panel based on the input image data, receive feedback voltages of the first power supply voltage from first areas of the plurality of areas in which voltage drop of the first power supply voltage occurs, and generate a power control signal for changing the level of the first power supply voltage based on the load value, the peak grayscale, and the feedback voltages, wherein the power supply includes a power supply voltage digital-to-analog converter configured to provide, to the display panel, a corrected first power voltage corresponding to the power control signal, wherein the power supply further includes a converter configured to drop the voltage level of the corrected first power voltage between the power supply voltage digital-to-analog converter and the display panel.

15. The display device of claim 14, wherein the data driver includes a plurality of source driver ICs mounted on each of a plurality of flexible films, and one side of each of the flexible films is connected to one side of the display panel.

16. The display device of claim 15, wherein the other side of each of the flexible films is connected to first printed circuit boards, part of the first printed circuit boards are directly connected through a first connection portion to a second printed circuit board on which the power supply is mounted, and the others of the first printed circuit boards are connected through a second connection portion to the part of the first printed circuit boards directly connected to the second printed circuit board.

17. The display device of claim 16, wherein the first areas include a first input terminal of the first printed circuit boards for supplying the first power supply voltage to a source driver IC relatively farther from the power supply in a first direction, and a second input terminal of the first printed circuit boards for supplying the first power supply voltage to a source driver IC relatively farther from the power supply in a second direction.

18. The display device of claim 17, wherein resistor dividers are provided on one side of the first input terminal and one side of the second input terminal, and the power controller is configured to receive feedback voltages of the first power supply voltage through the resistor dividers.

19. A power setting method of a display device including a display panel with a plurality of pixels, the power setting method comprising:

calculating a load value and a peak grayscale of the display panel based on input image data;

receiving feedback voltages of a first power supply voltage from relatively lower quality areas in which voltage drop of the first power supply voltage supplied to the display panel occurs relatively more frequently;

generating a power control signal for changing the level of the first power supply voltage based on the load value, the peak grayscale, and the feedback voltages, wherein the generating of the power control signal includes:

calculating a first power code value using the load value and the peak grayscale; and comparing magnitudes of the feedback voltages with a magnitude of a reference first power supply voltage, and the comparing of the magnitude of the voltage includes:

when substantially all of the feedback voltages are higher than the reference first power supply voltage, outputting, to the display panel, the power supply voltage corresponding to the first power code value;

when any one of the feedback voltages is lower than the reference first power supply voltage, increasing the first power code value and re-receiving feedback voltages; and comparing magnitudes of the re-received feedback voltages with a magnitude of the reference first power supply voltage.

20. The power setting method of claim 19, further comprising:

correcting the power control signal based on a proportion of the feedback voltages that deviate from a reference first power supply voltage; and outputting the corrected power control signal.

* * * * *